United States Patent [19]

Harrison-Smith et al.

[11] 4,237,916

[45] Dec. 9, 1980

[54] CRUTCHES

[75] Inventors: John L. Harrison-Smith; Henry B. C. Milsom, both of Tauranga, New Zealand

[73] Assignee: Fisher & Paykel, Limited, New Zealand

[21] Appl. No.: 974,115

[22] Filed: Dec. 28, 1978

[30] Foreign Application Priority Data

Jan. 13, 1978 [NZ] New Zealand ..... 186215
Mar. 10, 1978 [NZ] New Zealand ..... 186621

[51] Int. Cl.[3] ..... A61H 3/02
[52] U.S. Cl. ..... 135/69
[58] Field of Search ..... 135/69, 68, 82, 83, 135/75

[56] References Cited

U.S. PATENT DOCUMENTS

| | | | |
|---|---|---|---|
| 3,157,188 | 11/1964 | Farnham | 135/69 |
| 3,416,546 | 12/1968 | Carpenter | 135/69 X |
| 3,486,515 | 12/1969 | Chrysostomides | 135/69 |

*Primary Examiner*—J. Karl Bell
*Attorney, Agent, or Firm*—Holman & Stern

[57] ABSTRACT

A crutch has a piston 3 and cylinder 2 arrangement connected through a manually controlled valve (30, 54) and two one way ball valves 22,24 to a reservoir 12. A working fluid partly liquid and partly gas is compressed in the reservoir 12 and by manipulating the valve 30, 54 the user shortens the crutch by applying force between the handle 15 and the tip 5 and further manipulation of the valve 30,54 permits the liquid to resist shortening of the crutch.

6 Claims, 4 Drawing Figures

CRUTCHES

This invention relates to crutches.

It is an object of the present invention to provide a crutch which will at least provide the public with a useful choice.

Accordingly in one aspect the invention consists in a crutch comprising a piston and cylinder arrangement one of the piston and the cylinder thereof having a crutch tip which in use is placed on the ground, a reservoir for working fluid, a working fluid under pressure in said piston and cylinder arrangement and said reservoir, said working fluid being partly a liquid and partly a gas and a valve means manually operable to control the interchange of working fluid between said piston and cylinder arrangement and said reservoir and limb support means whereby a user may in use support himself by use of the crutch, the construction and arrangement being such that by manual manipulation of said valve means and by the application of force the user can cause contraction of the piston and cylinder arrangement with consequent flow of working fluid into said revervoir and by removing such force can allow the piston and cylinder arrangement to extend in length, such contraction and extension being resisted by further manipulation of said valve means.

In a further aspect the invention consists in a crutch comprising a piston and cylinder arrangement, one of the piston and the cylinder thereof having a crutch tip which in use is placed on the ground, a reservoir for a working fluid, said working fluid being partly liquid and partly gas, limb support means so that a user may in use support himself by the crutch and valve means arranged to control the interchange of working fluid between the piston and cylinder arrangement and the reservoir under control of the user so that when the user controls the valve means to a position which admits working fluid from the piston and cylinder arrangement into said reservoir compressing said gas and the user applies force to the piston and cylinder arrangement, that arrangement will contract in length and on the user changing the valve to another position such contraction will be resisted so that the user may then move himself up to a certain position using the crutch as a support and unless resisted by force the compressed gas in the reservoir is released into the piston and cylinder arrangement to extend the length of the piston and cylinder arrangement.

To those skilled in the art to which this invention relates, many changes in construction and widely differing embodiments and applications of the invention will suggest themselves without departing from the scope of the invention as defined in the appended claims. The disclosures and the description herein are purely illustrative and are not intended to be in any sense limiting.

Figure 2:
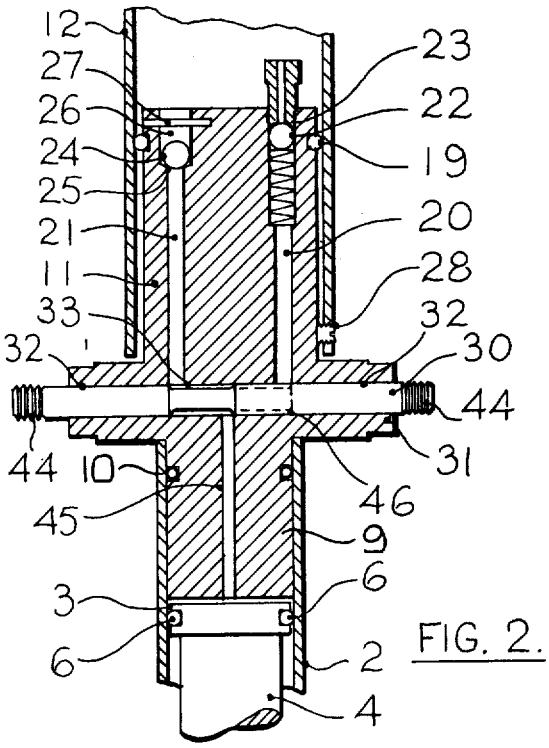
Figure 1:
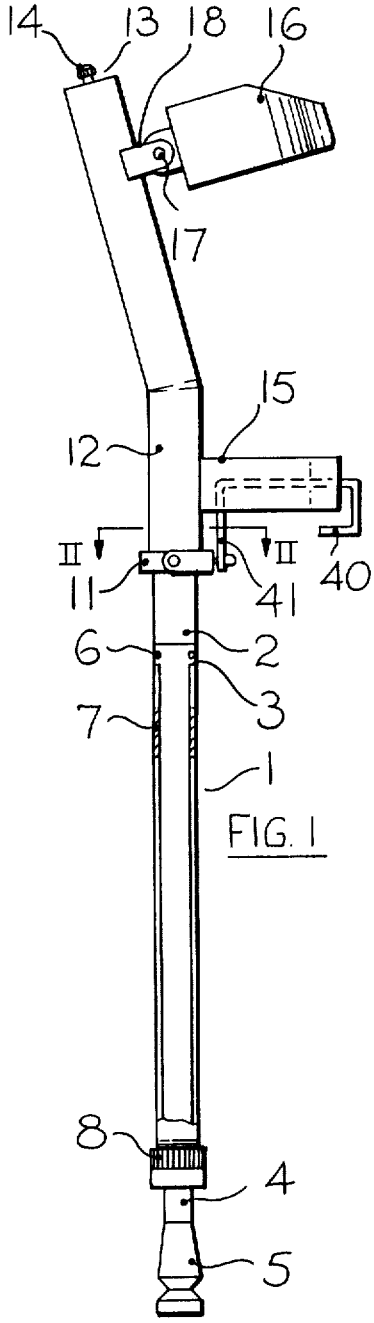
Figure 3:
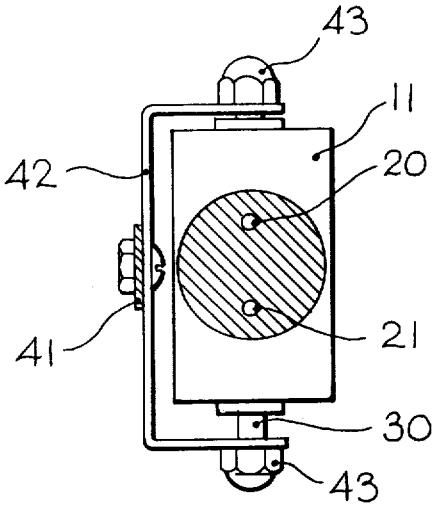
Figure 4:
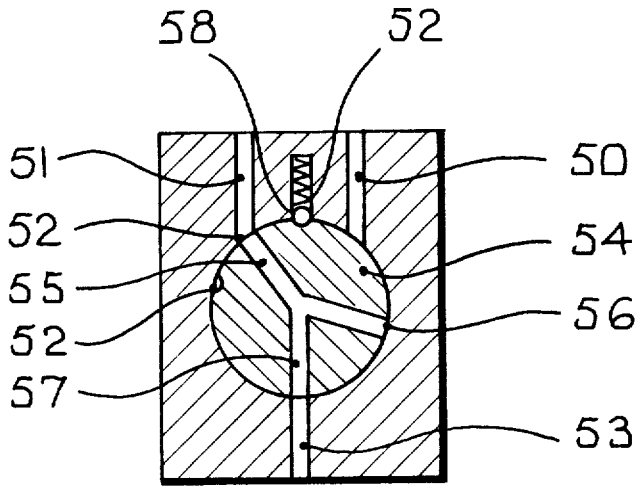

One preferred form of the invention will now be described with reference to the accompanying drawings in which, FIG. 1 is an elevation of a crutch constructed according to the invention, part of the cylinder being broken away to show the piston, FIG. 2 is a vertical cross section of a valve arrangement used in the crutch of FIG. 1, FIG. 3 is a horizontal cross section of the crutch on the line II—II FIG. 1, FIG. 4 is a sketch view of an alternative type of valve.

Referring to the drawings a crutch is constructed as follows.

A piston and cylinder arrangement 1 has a cylinder 2 in which a piston 3 runs, the piston 3 having a piston rod 4, the end of which terminates in a crutch tip 5. An O ring 6 is provided to seal the piston 3 against the inner wall of the cylinder 2 and guides 7 and 8 guide the piston rod 4 in the cylinder.

Cylinder 2 is fixed, for example, by being mounted with a screw (not shown) on a stub 9 an O ring 10 sealing the joint to a casting 11 and mounted on the casting 11 is a reservoir 12 for a working fluid, the working fluid being partly, for example an hydraulic oil but preferably water since there are no great technical demands on the liquid and water will be cleaner and more easily topped up by the user. In order to give some preliminary pressurisation of the gas a valve 13, for example, a Schrader valve such as is used for inflating vehicle tyres is used and to protect this valve cap 14 is fitted. To top up the oil or water, the whole valve 13 is removable. Mounted on the reservoir 12 are limb support means comprising a handle 15 and a fore arm C shaped member 16 the latter being pivotal at 17 on a bracket 18.

To control the interchange of working fluid between the interior of the cylinder 2 and the interior of the reservoir 12 valve means are provided as follows. The casting 11 is provided with passageways 20 and 21, the passageway 20 having a spring loaded ball valve 22 bearing against a valve seat 23 screwed into the casting 11 and this ball valve of course permits the passage of fluid from the reservoir 12 to the cylinder 2. The passage 21 has a ball valve 24 situated in chamber 26 resting against a seat 25, the ball being prevented from moving out of the chamber 26 by a pin 27. This valve permits passage of fluid from the cylinder 2 to the reservoir 12. The reservoir 12 is sealed to the casting 11 by an O ring 19 and the reservoir 12 is retained on the casting 11 by an Allen set screw 28.

To enable the user to control the flow of working fluid between the cylinder and the reservoir 12 a shuttle valve is provided having a spool 30 operating in a bore 31 in the casting 11. The spool 30 has lands 32 which are good tight working fits in the bore 31 and the spool 30 also has a portion 33 of reduced diameter.

To operate the spool 30 a control lever 40 (FIG. 1) is rotatable within the handle 15 and operates a lever 41 which in turn operates a yoke 42, the yoke 42 being fixed to the shuttle valve 30 by nuts 43 fitting on the threads 44 of the shuttle valve. The casting 11 has a central passageway 45 and the reduced portion 33 of the spool 30 when in one position i.e. as shown in full lines in FIG. 2 connects passageways 21 through passageway 45 interconnecting the cylinder 2 and the reservoir 12. When in the other position shown in dashed lines at 46 FIG. 2 the reduced portion connects to the passageway 20 through passageway 45 thus again interconnecting the cylinder 2 and the reservoir 12.

The use of the construction is as follows. A sufficient working liquid for example, an hydraulic liquid is inserted in the reservoir as to fill the cylinder 2 when the piston is in its fully extended position i.e. with the piston 3 close to the guide 8. The reservoir is then compressed to a desired extent with air by pumping air through the valve 13 and the device is ready for use.

When passage 21 is blocked i.e. the spool 30 has been moved to the right in FIG. 2, passage of working fluid from the cylinder 2 to the reservoir 12 is prevented by the spool 30 from reaching passage 21 and the ball 22 prevents passage of fluid into the reservoir from passage 20. However fluid may be passed from the reservoir 12 to the cylinder 2 thus extending the piston 3 from the cylinder 2 unless force is applied to the crutch to prevent such extension. Thus the piston rod 4 is locked against contraction when the valve is in this position but may be extended by the compressed gas if no force is applied between the handle 15 and the tip 5.

If now the control handle is operated to move the spool 30 to its other position i.e. to the left in FIG. 2, as a result flow of fluid from the reservoir to the cylinder is prevented by passageway 21 being closed by the ball 24 and passage 20 being closed by the spool 30. As a result no fluid can be forced out of the reservoir into the cylinder under the pressure in the reservoir. On the other hand looking at flow from the cylinder to the reservoir passageway 21 will be open and fluid may pass from the cylinder 2 to the reservoir 12. As a result of this, if force is applied between the handle 15 and the tip 5 e.g. some weight of the user supported on the crutch, such force, if sufficient, will cause the piston rod to be retracted into the cylinder. Thus the user may position the handle 15 of the crutch at any position over a range of positions above the ground by operation of the lever 40 and thus spool 30 and thus may best position the handle to enable him to use that handle and the support of the crutch to enable him to raise and lower himself as between, for example, a sitting and a standing position. The crutch may therefore be regarded as a crutch having a ratchet mechanism and by appropriate adjustment of the pressure of air within the reservoir 12 the user can stop extension of the crutch either by applying weight thereto appropriate to permit his use of the crutch.

In assisting the user to sit, the crutch is gradually contracted under the weight of the user, the spool 30 being to the left in FIG. 2. When the user has two crutches these are of assistance to the user in rising to a standing position, the user transferring his weight between the crutches to allow these to extend in stages and to resist force in successive positions until the required degree of extension is reached. The crutch is also helpful to a user climbing or descending stairs. For transportation in a vehicle the crutch can be locked in the fully contracted condition for convenience.

When the user of the crutch is in a standing position and wishes to sit down he operates the valve to enable fluid to travel from the cylinder 2 to the reservoir 12 i.e. he places the valve member to the left in FIG. 2. He then pushes down on the crutch with his weight and starts to move to a sitting position. As he moves, pushing the handle 15 of the crutch down, forces the piston 3 to move up within the cylinder 2 which forces oil to be moved upwardly through the passageway 45 between the bore 31 and the part 33 of the shuttle valve and through passage 21 into the reservoir. Once he has reached the sitting position the crutch remains in the contracted condition because fluid cannot pass back to the cylinder and the piston remains in its contracted position. Subsequently when he wishes to stand up again he will operate the spool 30 to the right in FIG. 2 to the position which allows the fluid to move downwardly through the valve i.e. through ball valve 23, passageway 20, the space between part 33 of the shuttle valve and the bore 31, and through the passageway 45. The compressed air above the liquid in the reservoir 12 assists the liquid to move the piston out of the cylinder 2 and thus provide some assistance to the user of the crutch in rising to a standing position and if he wishes to prevent extension of the piston rod from the cylinder he applies force thereto or changes the valve back to the left.

Adjustment to the rate of flow of fluid during transfer may be effected by providing restrictions in one or other or both of the passages 20 or 21. Such restriction may be either permanent e.g. by varying the size of the holes 20 or 21 or may be made adjustable by having an adjustable bleeder valve in each of these passageways.

In FIG. 4 there is shown a different valve arrangement in which the passages 50 and 51 corresponding to passages 20 and 21 have one way valves corresponding to the ball valves 22 and 25 and an outlet 53 which corresponds with the outlet 45 in FIG. 2. The valve has a rotary member 54 containing passageways 55,56 and 57. The valve member 54 has a series of depressions 52 in it corresponding to desired stop positions and a spring loaded ball 58 moves into the depressions to stop valve member 54 as desired.

As shown in FIG. 4 the passageways 55 and 57 connect inlet 51 to outlet 53 and inlet 50 is obturated. When the valve member 54 has turned through 30° both inlets 50 and 51 and outlets 53 are obturated i.e. the valve is in neutral or off disposition and when the valve member 54 is turned through a further 30° passageways 55 and 56 connect inlet 50 to outlet 53 and inlet 51 is obturated. Thus the arrangement not only provides the effects above outlined but in addition when the valve member 54 is in the neutral or off position with both inlets blocked to the outlet and conversely the outlet blocked to the inlet the piston is locked in its position in the cylinder.

At least in one or other or both described forms the invention provides a crutch which while being adjustable as to height between the handle of the crutch and the ground is reasonably light having regard to its function and which does not require any external power sources or portable power sources such as gas bottles or batteries.

The crutch acts as a ratchet in that the operative length of the crutch can be extended and will hold its extended position either by the application of force or by manipulating the valve in the extended or contracted disposition.

The oil or water is used to control the rate of the extension resulting from the compression of the gas. The crutch is what might be called a follower crutch. The patient or user actually raises himself by the use of the upper part of his body while the length of the crutch is locked and by operation of the valve such length can be adjusted in a series of steps in a ratchet like manner.

We claim:

1. A crutch comprising a piston and cylinder arrangement one of the piston and the cylinder thereof having a crutch tip which in use is placed on the ground, a reservoir for working fluid, a working fluid under pressure in said piston and cylinder arrangement and said reservoir, said working fluid being partly a liquid and partly a gas and a valve means manually operable to control the interchange of working fluid between said piston and cylinder arrangement and said reservoir and limb support means whereby a user may in use support himself by use of the crutch, the construction and arrangement being such that by manual manipulation of said valve means and by the application of force the user can cause contraction of the piston and cylinder arrangement with consequent flow of working fluid into said reservoir and by removing such force can allow the piston and cylinder arrangement to extend in length, such contraction and extension being resisted by further manipulation of said valve means.

2. A crutch comprising a piston and cylinder arrangement, one of the piston and the cylinder thereof having a crutch tip which in use is placed on the ground, a reservoir for a working fluid, said working fluid being partly liquid and partly gas, limb support means so that a user may in use support himself by the crutch and valve means arranged to control the interchange of working fluid between the piston and cylinder arrangement and the reservoir under control of the user so that when the user controls the valve means to a position which admits working fluid from the piston and cylinder arrangement into said reservoir compressing said gas and the user applies force to the piston and cylinder arrangement, that arrangement will contract in length and on the user changing the valve to another position such contraction will be resisted so that the user may then move himself up to a certain position using the crutch as a support and unless resisted by force the compressed gas in the reservoir is released into the piston and cylinder arrangement to extend the length of the piston and cylinder arrangement.

3. A self-contained variable length crutch which is adjustable by applying the weight of the user thereto comprising an elongated rod like member having a crutch tip at the lower end and a piston at the upper end, a valve body having a cylindrical extension on its lower part telescopingly engaging said piston to form a piston and cylinder arrangement, an upper elongated hollow cylindrical user support member attached at its lower end to the upper part of said valve body to form a sealed reservoir chamber therein, a crutch handle attached to said support member near the lower end thereof, valve means in said valve body including passageways connecting said piston and cylinder arrangement to said reservoir chamber, hydraulic fluid partially filling said chamber, gas under pressure above said hydraulic fluid in said chamber, fingertip control means attached to said crutch handle and operably connected to said valve means to shift it into different positions, said valve means being adapted to control the flow of hydraulic fluid between said reservoir chamber and said piston and cylinder so that in one position when the force of the gas pressure on the piston exceeds the force applied by the user the gas pressure will through the hydraulic fluid move said piston to lengthen the crutch and in another position when the force applied by the user exceeds the force of the gas pressure the piston will be driven in the opposite direction to shorten the crutch and force the hydraulic fluid to return to said reservoir chamber and re-compress said gas, said valve means including a position whereby the length of the crutch may be fixed.

4. A crutch as claimed in claim 1 or 3 wherein said valve means include two one way valves one permitting flow between said reservoir and said piston and cylinder arrangement and the other permitting flow from said piston and cylinder arrangement to said reservoir, and valves blocking the flow in the respective opposite directions.

5. A crutch as claimed in claim 4 wherein said valve means includes a shuttle valve operative when moved to one position to connect selectively one of said one way valves between said piston and cylinder arrangement and to obturate the flow through the other of said one way valves and operative when moved to another position to reverse said connections.

6. A crutch as claimed in claim 4 wherein said valve means includes a three position control valve having an inlet from each of said one way valves, an outlet and a manually movable member having passages which on the movable member being moved to one position obturate flow between a first one of said inlets and said outlet and permit flow from the second one of said inlets to said outlet and to the other inlet, on the movable member being moved to a second position will obturate said outlet and both said inlets and on the movable member being moved to a third position will obturate flow between said second inlet and said outlet and permit flow between said first inlet and said outlet.

* * * * *